US005478074A

United States Patent [19]

Storper

[11] Patent Number: 5,478,074

[45] Date of Patent: Dec. 26, 1995

[54] GOLF CLUB GRIP

[76] Inventor: Lars I. Storper, Emil Reesensvej 37, DK-7500 Holstebro, Denmark

[21] Appl. No.: 244,837

[22] PCT Filed: Dec. 14, 1992

[86] PCT No.: PCT/DK92/00376

§ 371 Date: Jul. 14, 1994

§ 102(e) Date: Jul. 14, 1994

[87] PCT Pub. No.: WO93/11835

PCT Pub. Date: Jun. 24, 1993

[30] Foreign Application Priority Data

Dec. 13, 1991 [DK] Denmark ..... 2000/91

[51] Int. Cl.[6] ..... A63B 53/14

[52] U.S. Cl. ..... 273/81.2; 273/165

[58] Field of Search ..... 273/81 R, 81 B, 273/81 D, 81.2, 165

[56] References Cited

U.S. PATENT DOCUMENTS

| | | | |
|---|---|---|---|
| 1,419,795 | 6/1922 | Yerger | 273/81.2 |
| 1,498,382 | 6/1924 | Johnston | 273/165 |
| 1,634,082 | 6/1927 | Rigby | 273/81.2 |
| 1,665,811 | 4/1928 | Hadden | 273/81.2 |
| 2,871,899 | 2/1959 | Coyle et al. | 273/81 R |
| 3,070,370 | 12/1962 | Steiner | 273/81 R |
| 3,524,646 | 8/1970 | Wheeler | 273/81.2 |
| 4,819,939 | 4/1989 | Kodayashi | 273/81 R |
| 4,826,168 | 5/1989 | McGuire et al. | 273/81.2 |
| 5,024,438 | 6/1991 | Candow | 273/81 R |
| 5,299,802 | 4/1994 | Bouchet-Lassale | 273/165 X |

*Primary Examiner*—William H. Grieb

*Attorney, Agent, or Firm*—Antonelli, Terry, Stout & Kraus

[57] ABSTRACT

Traditionally, a change out of the handle or grip coating on golf clubs is a difficult and expensive operation, which, according to the invention, is greatly facilitated in that the coating (16) is mounted on a thin-walled, stiff tube (10) designed with a longitudinal rib/groove profiling (16,12) on its interior side, while on the upper end of the club shaft (2) there is secured another and slightly narrower, thin-walled holding tube (4) having on its outside a complementary profiling. Thereafter desired handle or grip changes can be effected by the golfer in a simple manner, only by an easy axial insertion of the exterior grip element (16,10) onto the holder tube (10) and an associated locking together by means of a snap lock coupling (14,18 or 32,34). The rib/groove profiling is of the undercut type, whereby a very firm holding engagement is achievable in spite of the use of the thin-walled tubes.

8 Claims, 1 Drawing Sheet

GOLF CLUB GRIP

BACKGROUND OF THE INVENTION

The present invention relates to a golf club and more particularly to the handle or grip thereof, the invention dealing with the design of an easily exchangeable grip on such clubs. The most common is that the handle portion is provided by mounting of a special handle element, the so-called grip, on the upper end of the club tube or rod by a rather complicated technique, and it is not possible to carry out any easy or quick exchange of such a grip. It is well known, therefore, that the grip is exchanged only when it is worn down to such an extent that it will no longer provide for a safe hold of the club, this amounting to a real repair rather than just a change of a club part. This repair is both expensive and time consuming, and it can be made by the golfer himself only in exceptional cases.

It would be desirable that the golfers themselves could carry out not only such a repair, but also an easy and rapid change of a prefabricated handle element, whereby it would be possible for the golfer even during the game to change between different grip elements adapted for different situations of use.

The idea of such a design it not new, and several proposals for such changeable grips have been given. In practice, however, the proposals so far have been turned down by the international golf organisations, not because of non-attainment of the desired advantages, but because there are associated and apparently non-acceptable drawbacks, which should not be further specified here. It is to be emphasized, however, that the present invention provides for an exchange system which, almost sensationally, has been found acceptable by the said organisations, such that the system can be used in practice in international competition golf.

One of the said known proposals is disclosed in U.S. Pat. No. 4,819,939, according to which the handle end of the club rod is rigidly provided with a downwardly converging carrier bushing for a correspondingly shaped, resilient outer tube, which can be mounted on the bushing in being introduced over the upper, broader end thereof. This introduction will be rather difficult, as the outer 'grip tube' shall be expanded for passing over the said broader end, and it is a serious drawback that there is no effective prevention against a mutual rotation between the carrier bushing and the outer tube; moreover it is considered unlucky that the outer pipe at any place of it can be drawn radially outwardly from the carrier bushing. Also, after all, a changing of the grip tube will still be a difficult operation, which may well be done for renewal or repair, but not for an operational rapid replacement with another type or dimension of the outer pipe.

According to U.S. Pat. No. 3,524,646 it has also been proposed that the entire handle portion of the club may be detachably secured to the club rod as a separate unit, which will then, of course, be changeable with another, corresponding unit of some other shape or character, but also this solution has been professionally rejeted. It is conditioned by special and therewith heavy coupling means for joining the upper end of the club rod with the upper extension constituted by the entire handle part, and the latter part itself should have to be made as a stiff and relatively expensive element.

Still a further proposal for exchangeable grips is disclosed in U.S. Pat. No. 4,826,168, where a cylindrical grip element can be inserted over the upper end of the club rod and be secured thereto by means of a particular end fixture, which, however, requires a special design of the upper end of the club rod. Neither in this case there will be any safety against mutual rotation of the club rod and the surrounding grip part, and not either against radial retraction of the outer grip part from the outside of the club rod or pipe.

SUMMARY OF THE INVENTION

It is the aim of the invention to provide a solution, whereby it is possible, in a fully suitable manner, to effect a change of an outer grip element on the top end portion of a golf club by an operation that is easy and convenient to carry out for the attainment of a stable fixation.

According to the invention this is achievable when the handle portion of the club is designed to have an inner tube member for fixed mounting on the handle end of the club shaft and an outer tube member for replaceable mounting on the inner tube member, wherein the inner tube member is a preferably straight cylindrical member of a rigid material, e.g., metal or plastics, the outer side thereof being profiled with a system of longitudinal ribs/grooves having a pitch and an amplitude which are both small relative the radius of this tube member, and that the outer tube member, having at its outside an optionally conventional grip material coating, is likewise made from a rigid material and has a complementary groove/rib profiling for insertion engagement with the profiling of the outside of the inner tube member, the handle further having means for releasable axial fixation of the insertion joint between the outer tube member and the inner tube member or the club shaft, respectively. With the specified design of the telescopic, rigid tube portions any possibility of a mutual rotation between the tubes after the mounting will be excluded, and with the specified rib/groove profiling having narrow cross sectional dimensions the tubes may have a relatively small wall thickness, such that they do not disqualify the handle on account of increased thickness.

The outer tube may be extra thin when the profiling on both of the tubes is of the undercut type, as the tube will then be safeguarded against local, radial bulging out from the inner tube, which, itself, may be effectively anchored to the club shaft, e.g. by means of a strong glue; thereby also the inner tube may have a small wall thickness. This is of particular significance in that consequently it will be possible to use for the exterior grip coating the same 'grips' as already existing for mounting directly on the club shafts.

The fixation of the outer tube against retraction from the inner tube, of course, should be very efficient, but this is rather easily achievable, e.g. with the use of various types of snap lock means, which can also be easily releasable when this is expressly desired. When the golfer has a number of different grips at disposal it will even be possible to change the grip during the game, either for adaptation to a special situation or only because of a grip having become more wet than desired.

BRIEF DESCRIPTION OF THE DRAWINGS

In the following the invention is described in more detail with reference to the drawing, in which.

DETAILED DESCRIPTION OF THE PREFERRED EMBODIMENTS

Figure 1:
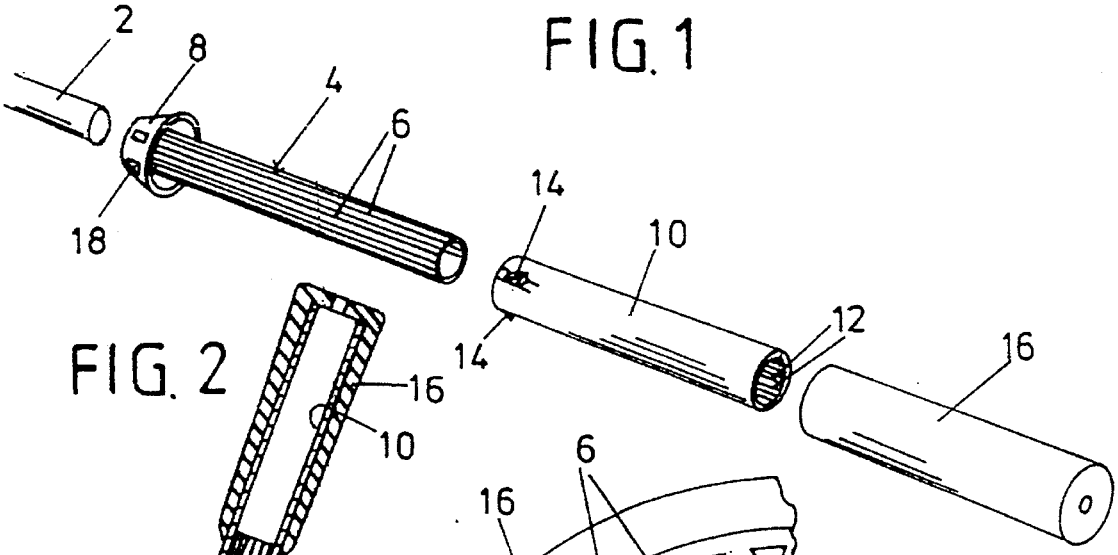
FIG. 1 is a perspective exploded of view of a handle according to the invention.

In FIG. 1 is shown the upper end of a golf club shaft 2 and a thin walled tube 4 to be mounted on that shaft with snug fit for a rigid fastening by means of glue. In its outer side the tube 4 is provided with a relatively large number of longitudinal ribs 6 with intermediate grooves, see also FIG. 3, and moreover this tube has a collar portion 8 at the end facing the shaft 2, this collar portion being a locking means as described below. Also shown is a tube 10, the inner side of which is profiled with longitudinal ribs 12 adapted for reception in the grooves between the ribs 6 of the tube 4, when the tube 10 is axially inserted over the tube 4. At its front end the tube 10 is provided with a number of forwardly projecting locking pawls 14. For mounting on the outside of the tube 10 is shown a conventional golf grip 16, which is a cylindrical or hood-like member moulded in a rubber like material with a gripping pattern in its surface.

Figure 2:
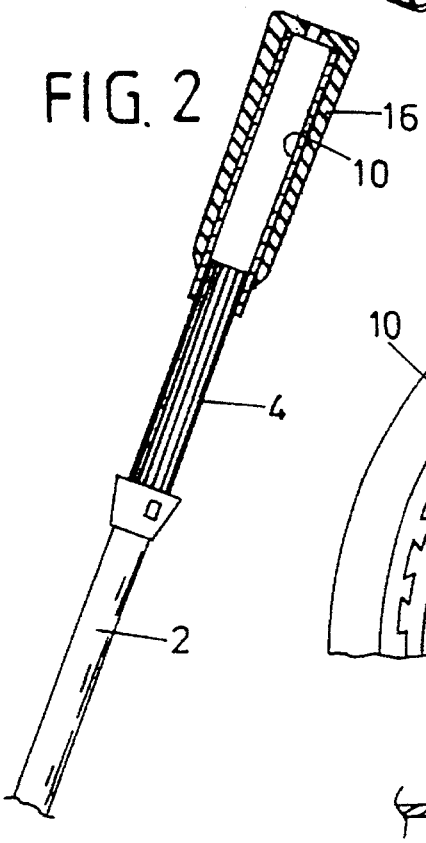
FIG. 2 is a longitudinal sectional view thereof.
Figure 4:
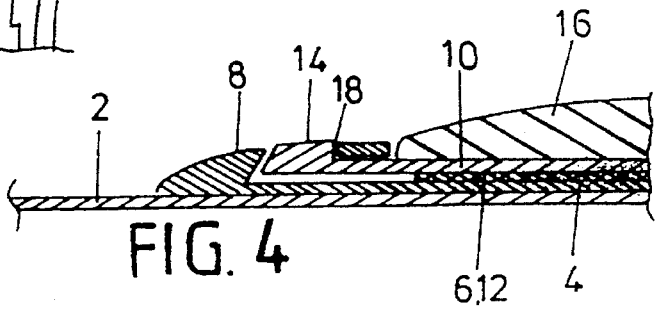
FIG. 4 is a longitudinal sectional view of a locking part therein.

The grip 16 can be fastened to the tube 10 in quite the same manner as it would otherwise be fastened directly on the club shaft 2, and as mentioned the tube 4 can be effectively secured to the shaft by a suitable glueing technique. When the shaft—or the shafts in a set of clubs—have once been provided with the tubes 4, the user will then be able to change, very easily, between different grip elements 10,16, as these elements are freely insertable onto the tube 4, confer FIG. 2. By such insertion the pawls 14 will lockingly engage in locking holes 18 in the collar portion 8, whereby a safe axial anchoring will be achieved. This anchoring, however, will be easy to release by forcing the pawls 14 inwardly, see also FIG. 4, whereafter the grip element 10,16 will be easy to retract from the tube 4.

Of course, a certain standardizing for clubs of different types will be required, but in practice only few different shaft diameters are in use.

Figure 3:
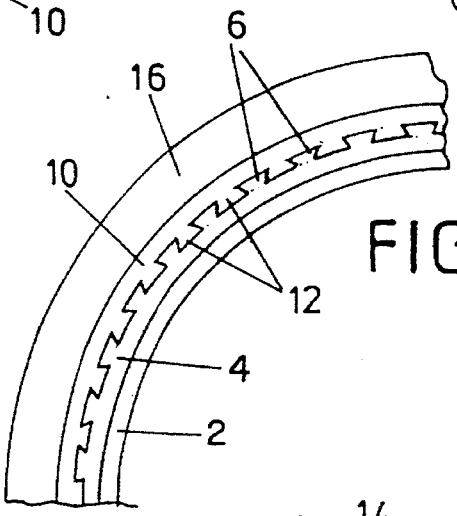
FIG. 3 is a cross sectional view of a part thereof.

As shown in FIG. 3 the said ribs and grooves are preferably designed so as to be undercut, whereby an intimate fixation between the thin walled tubes 4 and 10 is obtained.

Figure 5:
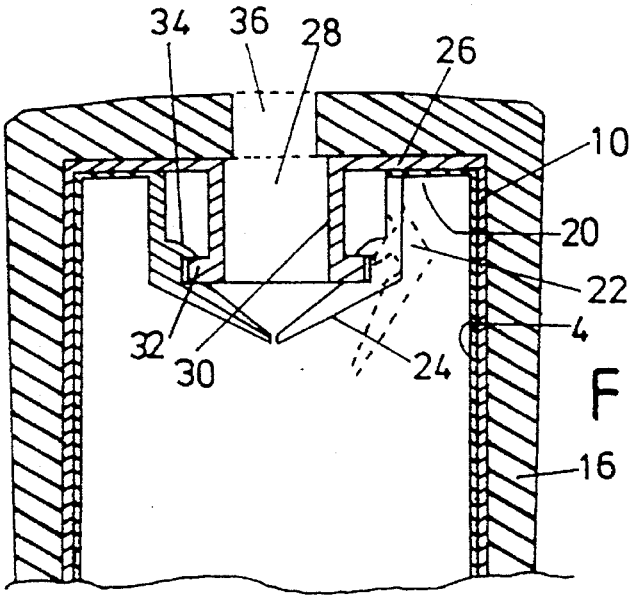
FIG. 5 is a longitudinal sectional view illustrating another locking system.

FIG. 5 illustrates an alternative possibility for the axial locking of the mounted grip element 10,16. Here the outer end of the inner tube 4—or even the corresponding outer end of the shaft 2—is connected with an inwardly projecting flange 20, from which, at more places around a central opening in the flange, there extend locking hooks 22, which at their outer ends continue towards the central axis through oblique arm portions 24. In a corresponding manner hte outer pipe 10 has an inwardly extending flange 26 with a central opening 28, from the edge of which there projects a bushing 30 having at its exterior end a collar widening 32 for cooperation with the locking hooks.

By the mounting of the grip element 10,16, the collar flange 32 will hit against oblique edge portions 34 on the locking hooks 22, such that these will be swung out and at the end of the mounting and snap in again so as to lock the bushing 30 and therewith the entire unit 10,16. In the top portion of the standard grip 16 there is provided a hole 36 having the diameter of a golf tee shaft, and when such a tee is stuck through the hole 36 the oblique arm portions 24 will be swung out for releasing the locking engagement, as illustrated in dotted lines, whereafter the grip element 10,16 is free to be pulled off.

It has been endavoured to design the system in such a manner that the changes can be effected without the use of special tools, but the invention, of course, will also comprise the implication of other locking arrangements, which might require a tool, e.g. a screw driver for an end screw on the grip, cooperating with a threaded hole in a fixed plug in the end of the shaft 2,4.

As mentioned, the tubes 4 and 10 are preferably of a straight cylindrical shape, but the invention is not limited to that. The cooperating surfaces may well—and even advantageously—be slightly conically shaped, particularly when produced by injection moulding, although it may then be necessary to renounce the undercut locking engagement. Correspondingly it would be possible to design the smooth surfaces with a non-cylindrical shape for adaptation to special shapes of the club shaft and the outer grip, respectively; besides, the said smooth surfaces should not necessarily be smooth.

It will be a further advantageous possibility to make the grooves in the tube 4 be slightly wedge shaped, with the wider width at the free end of the tube, and with the ribs of the tube 10 being shaped complementarily. Hereby the introduction of the tube 10 is facilitated, as the tight coupling will not be established until at the end of the introduction. With an otherwise straight cylindrical profiling of the tubes the undercut shape of the ribs and grooves can be maintained. Besides, a slightly wedged configuration can be used also as far as the height/depth of the ribs and grooves are concerned.

I claim:

1. A golf club handle of the type comprising an inner tube member for fixed mounting on the handle end of a club shaft and an outer tube member for replaceable mounting on the inner tube member, wherein the inner tube member is made of a rigid material, the outer side thereof being profiled with a system of longitudinal ribs/grooves having a pitch and an amplitude which are both small relative the radius of the inner tube member, and wherein the outer tube member, having at its outside a grip material coating, is made from a rigid material and has a complementary groove/rib profiling for insertion engagement with the profiling of the outside of the inner tube member, the handle further having means for releasable axial fixation of the insertion joint between the outer tube member and the inner tube member or the club shaft, respectively.

2. A handle according to claim 1, in which the rib/groove profiling on both of the tubes is of the undercut type.

3. A handle according to claim 1, in which the fixation means comprise a pawl lock system at one end of the assembled tubes.

4. A handle according to claim 1, in which the fixation means are constituted by a snap locking system at the outer end of the assembled tubes, inside therein, while the outer end portion is provided with an orifice for insertion of a tool to cause a release of the locking engagement.

5. A handle according to claim 1, in which the rib/groove profiling is shaped slightly wedged, so that an operational engagement is not established until the last phase of the bringing together of the tubes.

6. A handle according to claim 1, in which the rigid material of which the inner and outer tube members are made is selected from the group consisting of metal and plastic.

7. A handle according to claim 1, wherein the inner tube member is a straight cylindrical member.

8. A handle according to claim 1, is a conically shaped member.

* * * * *